United States Patent [19]

Tanaka et al.

[11] Patent Number: 4,878,045

[45] Date of Patent: Oct. 31, 1989

[54] LOCKING CABLE FOR ANTITHEFT DEVICES

[75] Inventor: Yoshiaki Tanaka, Kawagoe; Yaslehero Tanaka; Mujazaki; Toshekazu Kawakami; both of Tesuo Yamagata, Tokyo, all of Japan

[73] Assignees: Honda Giken Kogyo K.K., Tokyo; Kabushiki Kaisha Honda Rokku, Miyazaki-ken, both of Japan

[21] Appl. No.: 813,390

[22] Filed: Dec. 26, 1985

[30] Foreign Application Priority Data

Dec. 27, 1984 [JP] Japan ..... 59-273587
Dec. 27, 1984 [JP] Japan ..... 59-273588
Dec. 27, 1984 [JP] Japan ..... 59-196276[U]

[51] Int. Cl.[4] ..... G08B 29/00

[52] U.S. Cl. ..... 340/556; 70/233; 340/571; 350/96.23

[58] Field of Search ..... 340/568, 531, 555, 556, 340/571, 557; 200/61.12; 350/96.2, 96.15, 96.23; 70/233, 76

[56] References Cited

U.S. PATENT DOCUMENTS 4,525,702 6/1985 Kitagawa et al. ..... 340/556
4,574,192 3/1986 Kitagawa et al. ..... 350/96.23
4,639,713 1/1987 Kitagawa et al. ..... 350/96.1

FOREIGN PATENT DOCUMENTS 5862791 3/1960 Japan .
2109109 5/1983 United Kingdom ..... 70/233
2109547 6/1983 United Kingdom ..... 70/233

*Primary Examiner*—Joseph A. Orsino
*Assistant Examiner*—Brent A. Swarthout
*Attorney, Agent, or Firm*—Arthur L. Lessler

[57] ABSTRACT

A locking cable for use in an antitheft device adapted to give warning in response to a change in a photo signal transmitted through an optical fiber longitudinally extending through the locking cable. The locking cable comprises a core portion including the optical fiber, a reinforcing layer concentrically disposed around the core portion and including at least one electric conductor and a plurality of reinforcing members, and a flexible hollow protective member as an outermost layer covering the electric conductor and reinforcing members in contact with the protective member. If required, a further reinforcing layer may be interposed between the core portion and the first-mentioned reinforcing member, which includes a plurality of second reinforcing members. A holder holding an end of the optical fiber and a photoelectric element in face-to-face relation to each other is axially movably arranged within a plug connected to an end of the locking cable. Space is defined between the plug and the holder, through which the electric conductor axially movably extends.

8 Claims, 7 Drawing Sheets

LOCKING CABLE FOR ANTITHEFT DEVICES

BACKGROUND OF THE INVENTION

This invention relates to an antitheft device which is operable to photoelectrically detect cutting of a locking cable (lock wire) including an optical fiber and electric conductors, for giving an alarm, and more particularly to improvements in the locking cable.

An antitheft device for vehicles such as motorcycles is known from Japanese Provisional Patent Publication (Kokai) No. 58-62791 by the assignee of the present application, which uses a locking cable, through which an optical fiber and electric conductors extend. This antitheft device is used in such a manner that a vehicle, which is to be protected from theft, is tied to a solid structure by means of the locking cable, while a photo signal is transmitted from a light emission element to a light receiving element through the optical fiber. When the locking cable is cut in two to cause interruption of the transmission of the photo signal from the light emission element to the light receiving element, the cutting of the locking cable is detected to actuate a warning device to give warning.

Such locking cable used in the conventional antitheft device comprises a core, an inner layer, and an outer layer, for instance. The core is formed of an optical fiber extending longitudinally along the axis and covered with a protective member made of a synthetic resin. The inner layer is formed of two electric conductors wound around the outer peripheral surface of the core, together with a plurality of auxiliary cords having almost the same diameter as the electric conductors, and the electric conductors and auxiliary cords are covered with a protective member made of a synthetic resin. The outer layer is formed of a plurality of strands each formed of twisted steel wires and wound around the outer peripheral surface of the inner layer, and covered with a protective member made of a synthetic resin. The inner layer including the electric conductors is firmly held between the core and the outer layer.

With the above arrangement, the electric conductors in the inner layer have very small freedom to move in the twisting direction or in the opposite direction. When a bending force is given to the locking cable with such a magnitude and through such an angle as to exceed the freedom, the electric conductors will be cut. Therefore, the flexibility of the locking cable is set such that the locking cable can be bent only by a force and through an angle not exceeding the freedom, which imposes a limitation upon the minimum winding diameter of the locking cable when it is accommodated in the form of a coil within an accommodating space of the vehicle.

The locking cable constructed as above is connected to the antitheft device with a plug or plugs provided at an end or ends of the locking cable to be locked and unlocked with respect to the antitheft device by a key. The light emission element and the optical fiber have their ends disposed in face-to-face relation with a predetermined space therebetween within the plug and held in place by a holder provided in the plug. The electric conductors are held between the outer peripheral surface of the holder and the inner peripheral surface of the plug. Therefore, neither of the optical fiber and the electric conductors can be moved axially in the plug. This also imposes a limitation upon the minimum winding diameter of the locking cable when it is wounded into a coil.

SUMMARY OF THE INVENTION

It is the object of the invention to provide a locking cable of an antitheft device wherein electric conductors and an optical fiber are disposed to have enhanced freedom to move axially of the locking cable in response to bending of the latter, making it possible to wind the locking cable in a coil with a small diameter and to accommodate same within a small space.

According to the invention, there is provided an antitheft device which comprises a locking cable, an optical fiber longitudinally extending through the locking cable, a pair of photoelectric elements arranged at opposite ends of the optical fiber, and warning means responsive to a change in an electric signal generated by one of the photoelectric elements and corresponding to a change in a photo signal generated by the other photoelectric element and transmitted though the optical fiber.

The locking cable comprises: a longitudinally extending core portion including the optical fiber disposed along an axis thereof; a longitudinally extending reinforcing layer concentrically disposed around the core portion and including at least one electric conductor, and a plurality of reinforcing members; and a flexible hollow protective member forming an outermost layer and covering the at least one electric conductor and said reinforcing members in a manner such that the at least one electric conductor and the reinforcing members are disposed in contact with the flexible hollow protective member.

In another embodiment, the locking cable comprises: a longitudinally extending core portion including the optical fiber disposed along an axis thereof; a longitudinally extending first reinforcing layer concentrically disposed around the core portion and including a plurality of first reinforcing members; a longitudinally extending second reinforcing layer concentrically disposed around the first reinforcing layer and including at least one electric conductor and a plurality of second reinforcing members; and a flexible hollow protective member forming an outermost layer and covering the at least one electric conductor and the reinforcing members in a manner such that the at least one electric conductor and the second reinforcing members are disposed in contact with the flexible hollow protective member.

The antitheft device includes a fixture fixed to an object which is to be protected from theft, and connecting means for mechanically and electrically connecting the locking cable to the fixture, the connecting means comprising a plug provided at an end of the locking cable, a guide sleeve arranged within the plug, and a holder axially movably disposed within the guide sleeve, the holder holding an end of the optical fiber in face-to-face relation to an end of one of the photoelectric elements. At least one space is defined between an inner peripheral surface of the plug and an outer peripheral surface of the guide sleeve. The at least one electric conductor axially movably extends through the at least one space.

The above and other objects, features and advantages of the invention will be more apparent from the ensuing detailed description taken in conjunction with the accompanying drawings.

DETAILED DESCRIPTION

The invention will now be described in detail with reference to the drawings showing embodiments thereof.

Figure 1:
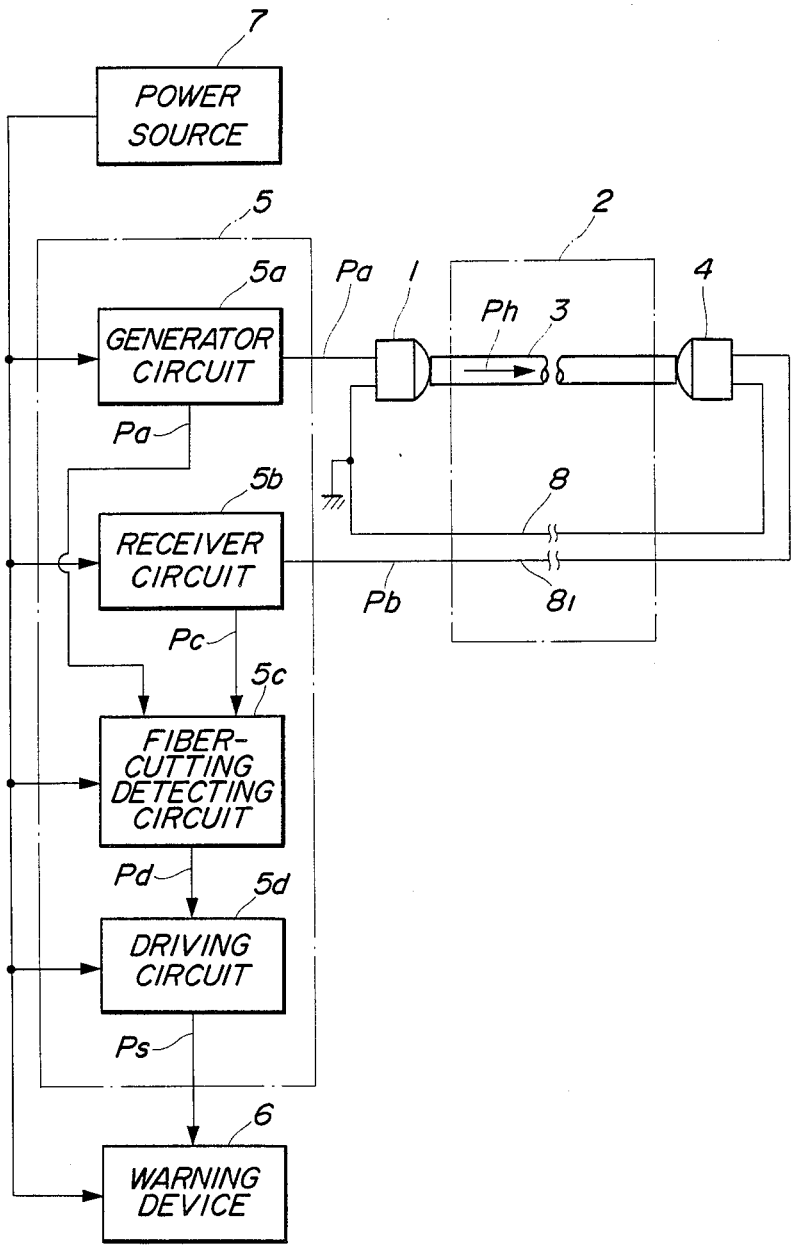
FIG. 1 is a block diagram showing an electrical circuit of an antitheft device to which a locking cable according to the invention is applicable.

Referring first to FIG. 1, an electrical circuit of a antitheft device is illustrated, to which a locking cable according to the invention is applicable. In the figure, reference numeral 1 designates a light emission element or light emission diode (LED), which is provided at an end of an optical fiber 3 extending through the locking cable 2 according to the invention. Provided at another or opposite end of the optical fiber 3 is a light receiving element or phototransistor 4. The light emission element 1 and the light receiving element 4 are both electrically connected to an electrical circuit 5. The electrical circuit 5 drives the light emission element 1 and the light receiving element 4 and generates a warning signal in response to an output of the light receiving element 4. A warning device 6 is connected to the output side of the electrical circuit 5. A power source 7 is connected with the electrical circuit 5 and the warning device 6. Lead wires or electric conductors 8 and $8_1$ are fitted through the locking cable 2 according to the invention and connected between the light receiving element 4 and the electrical circuit 5.

The electrical circuit 5 comprises a generator circuit 5*a*, a receiver 5*b*, a fiber-cutting detecting circuit 5*c*, and a driving circuit 5*d*. The generator circuit 5*a* may be formed by a pulse generator, which is adapted to generate an electric pulse signal Pa having a predetermined constant pulse repetition period. The light emission element or diode 1, which is adapted to convert an electric signal into a corresponding photo signal, is operable in response to the pulse signal Pa to generate a corresponding photo pulse signal Ph. This photo pulse signal Ph is transmitted through the optical fiber 3 to the light receiving element or phototransistor 4, which is adapted to convert a photo signal into a corresponding electric signal, is operable in response to the photo pulse signal Ph inputted thereto through the optical fiber 3 to generate a corresponding electric signal Pb. The receiver circuit 5*b* is arranged to receive and detect the signal Pb supplied thereto from the light receiving element 4 to generate a corresponding electric signal Pc. The fiber-cutting detecting circuit 5*c* is arranged to be supplied with the pulse signals Pa and Pc, respectively, from the generator circuit 5*a* and the receiver circuit 5*b* for detection of disconnection or cutting of the optical fiber 3, depending upon the input signals. For instance, it can be adapted to determine fulfillment of an AND condition between the levels of the signals Pa and Pc to generate an abnormality-indicative signal Pd when it determines that the AND condition is not fulfilled. The driving circuit 5*d*, which is adapted and arranged to actuate the warning device 6, is responsive to the input signal Pd to generate a driving signal Ps. The warning device 6, which can be formed of a buzzer, is responsive to the input driving signal Ps to give an alarm.

Figure 2:
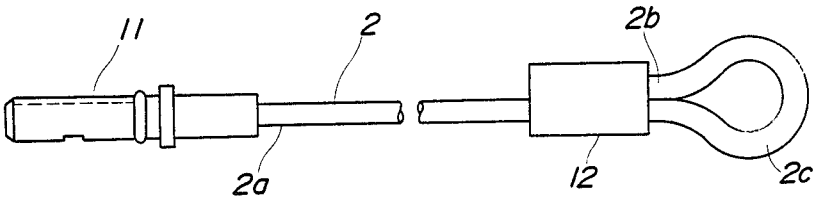
FIG. 2 is an elevational view of the locking cable.
Figure 3:
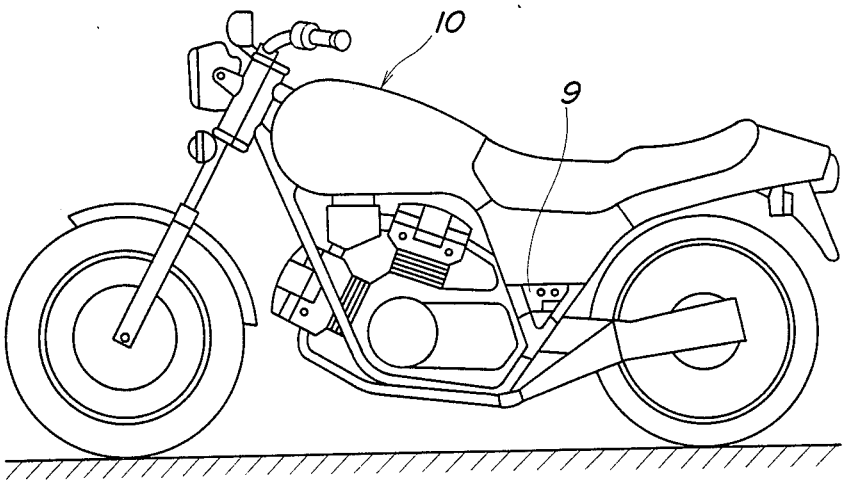
FIG. 3 is a side view of a motorcycle on which the antitheft device is mounted.
Figure 4:
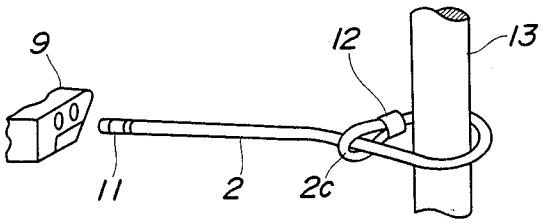
FIG. 4 is a schematic view of the locking cable wound round a pole and the antitheft device.

Referring to FIG. 4, the external appearance of the antitheft device including the electrical circuit of FIG. 1 is illustrated. This device is provided with the locking cable 2 and a main casing 9. The main casing 9 contains the electrical circuit 5, the warning device 6 and the power source 7, and can be fixedly mounted on a vehicle 10 like a motorcycle at a predetermined location as illustrated in FIG. 3. The locking cable 2 of the invention carries a strong metallic plug 11 secured on the end 2*a* as shown in FIG. 2, and accomodates the light emission element 1. A portion of the locking cable 2 including the other end 2*b* is formed as a loop 2*c*, wherein the end 2*b* is located within a caulking metal holder 12 which is caulked to firmly join the end 2*b* with the other end of the loop 2*c* located within the same holder 12. At the other end 2*b* of the locking cable 2 the light receiving element 4 is supported in a capsule (not shown) and disposed in alignment with an end of the optical fiber 3. The other end 2*b* is held in place together with the capsule within the metal holder 12 by means of caulking the metal holder 12.

The plug 11 and the main casing 9 have respective engaging means for engaging them with each other, which are adapted to inhibit disengagement of the plug 11 from the main casing 9 without using a key once the former has been engaged with the latter.

The main casing 9 is provided with a connector for engagement with a connector of the plug 11 (neither of which is shown). Therefore, when the plug 11 is engaged with the main casing 9, the electrical circuit 5 is electrically connected with the light emission element 1 and the light receiving element 4.

To tie the vehicle 10 to a pole 13, for instance, first the locking cable 2 is wound around the pole 13 and then the plug 11 is passed through the small loop 2*c*, as shown in FIG. 4, followed by fitting the plug 11 into the socket of the main casing 9. After the vehicle 10 has been tied to the pole 13, it is difficult to untie the vehicle 10 unless the locking cable 2 is disengaged from the main casing 9 by means of a key or it is cut with a wire cutter or the like. If the locking cable 2 is cut, the warning device 6 is actuated to give an alarm as stated before. If at least one of the optical fiber 3, and lead wires 8 and $8_1$ fitted in the locking cable 2 is cut, the fiber-cutting detecting circuit 5c is actuated to detect abnormality and actuates the warning device.

The construction of the locking cable 2 according to the invention used as above will now be described with reference to FIGS. 5 and 6.

Figure 5:
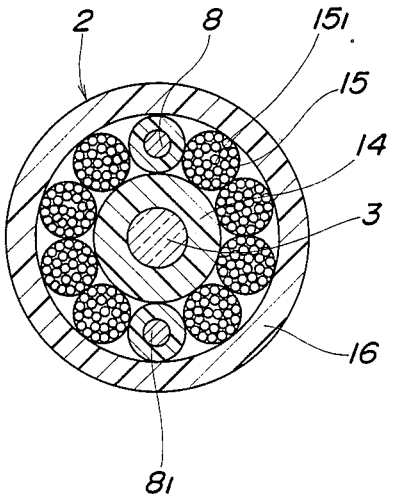
FIG. 5 is a transverse cross-sectional view of the locking cable according to an embodiment of the invention.

Referring to FIG. 5, a transverse cross section of the locking cable 2 is illustrated. The optical fiber 3 is arranged at the diametric center of the locking cable 2 and longitudinally extends along the axis of the member 2 to form a core. The optical fiber 3 is covered with a hollow flexible protective member 14 formed of a synthetic resin such as polyvinyl chloride and polyethylene. Two lead wires or electric conductors 8 and $8_1$ are disposed concentrically with the core or wound around the outer peripheral surface of the protective member 14, together with a plurality of, e.g. eight, reinforcing cords 15 having almost the same diameter as the former, thus forming a reinforcing layer together. The lead wires 8, $8_1$ and the reinforcing cords 15 are wound around the core in a manner longitudinally extending parallel with each other. The two lead wires 8, $8_1$ are diametrically symmetrically arranged with respect to the core. These lead wires 8 and $8_1$ and the cords 15 are covered with a hollow flexible protective member 16 formed of a synthetic resin similar to that of the member 14 and forming an outermost or surface layer. Each of the reinforcing cords 15 comprises a plurality of strands, each formed of a plurality of, e.g. seven, twisted steel wires $15_1$.

As noted above, the optical fiber 3 is arranged at the diametric center of the locking cable and extends along the axis of the latter in a streamline manner. Therefore, it does not have any unnecessary curved portion and can accordingly transmit light or a photo pulse signal Ph through a minimum distance from an end to the opposite end. In other words it minimizes the transmission loss of the photo pulse signal Ph.

Further, since the optical fiber 3 is enclosed by the protective member 14, the lead wires 8, $8_1$, the reinforcing cords 15 and the protective member 16, etc., it is fully protected from being damaged by external disturbances, and accordingly has a long life.

The lead wires 8 and $8_1$ are not limited in number to two as in the illustrated embodiment, but only a single such lead wire may be used. In such a case, the reinforcing cords 15 may be arranged to conduct electric current therein, for use as one of the electric conductors.

The numbers of the reinforcing cords 15 and the twisted steel wires $15_1$ are not limitative, but may be selected at any desired or required numbers, depending upon the required outer diameter, strength, etc. of the locking cable 2.

According to this embodiment, the lead wires 8, $8_1$ form the outer layer, and are covered only with the flexible hollow protective member 16 in a directly contacting fashion together with the reinforcing cords 15. Therefore, they have greater freedom to move in the twisting direction or in the opposite direction as compared with the aforementioned conventional locking cable, so that the locking cable can be designed with enhanced flexibility. As a result, the winding diameter of the locking cable 2 can be reduced to enable accommodating the member 2 in a coil within a small space.

Particularly, as the lead wires 8, $8_1$ and the reinforcing cords 15 have the same diameter, the lead wires and the reinforcing cords move circumferentially with the pitch maintained constant when the locking cable 2 is wound into a coil so that the lead wires are not given excessive stress and accordingly not easily broken.

Figure 6:
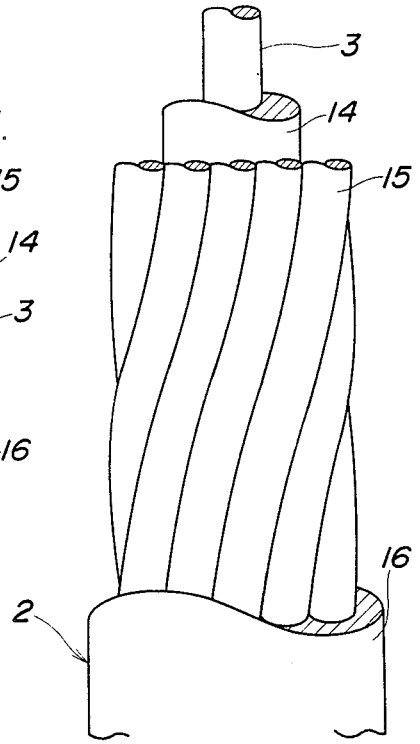
FIG. 6 is a fragmentary side and broken view showing the locking cable of FIG. 5.
Figure 7:
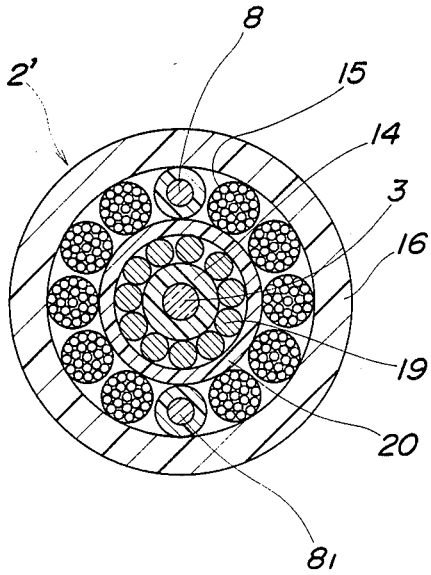
FIG. 7 is a transverse cross-sectional view of the locking cable according to another embodiment of the invention.
Figure 8:
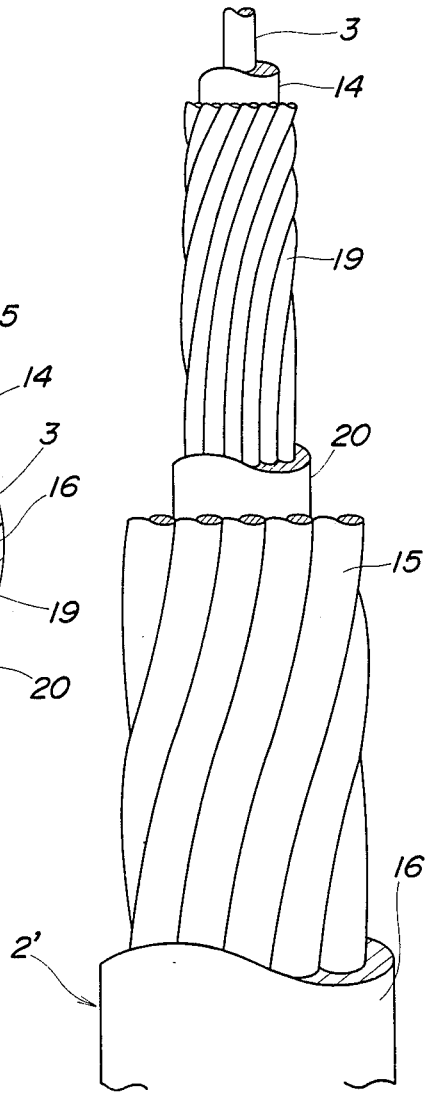
FIG. 8 is a fragmentary side and broken view showing the locking cable of FIG. 7.

Referring to FIGS. 7 and 8, another embodiment of the invention is illustrated. In FIGS. 7 and 8, elements and parts corresponding to those in FIGS. 5 and 6 are designated by identical reference characters.

In a similar manner to the aforedescribed embodiment, the optical fiber 3 is arranged at the diametric center of the locking cable 2' and longitudinally extends along the axis to form a core. The optical fiber 3 is covered with a hollow flexible protective member 14 formed of a synthetic resin such as polyvinyl chloride and polyethylene. A plurality of, e.g. ten, auxiliary cords 19 used as second reinforcing members are wound around the outer peripheral surface of the protective member 14 in a manner longitudinally extending parallel with each other, forming an inner or first reinforcing layer. The auxiliary cords 19 may be formed of a cheap material, for instance, a yarn or twisted thread of a natural fiber or a chemical or synthetic fiber. The auxiliary cords 19 are covered with a hollow flexible protective member 20 formed of a similar material to that of the protective member 14. Two lead wires of electric conductors 8 and $8_1$ are disposed concentrically with the core or wound around the outer peripheral surface of the protective member 20 similarly to the aforementioned embodiment, together with reinforcing cords 15 having almost the same diameter as the former, in a manner longitudinally extending parallel with each other, forming an outer or second reinforcing layer. Further, the lead wires 8, $8_1$ and reinforcing cords 15 are covered in a directly contacting manner with a hollow flexible protective member 16 formed of a synthetic resin such as polyvinyl chloride and forming an outermost or surface layer.

According to this embodiment, in addition to similar advantages to those provided by the aforedescribed embodiment in FIGS. 5 and 6, the radial distance between the optical fiber and the electric conductors is greater than that in the previous embodiment comprising a core and a single layer coaxial with the core, since the present embodiment comprises a core and two layers coaxial with the core, which facilitates the connection of the electric conductor with the light emission and receiving elements and enables the connection without obstructing the optical axis of the optical fiber.

Figure 9:
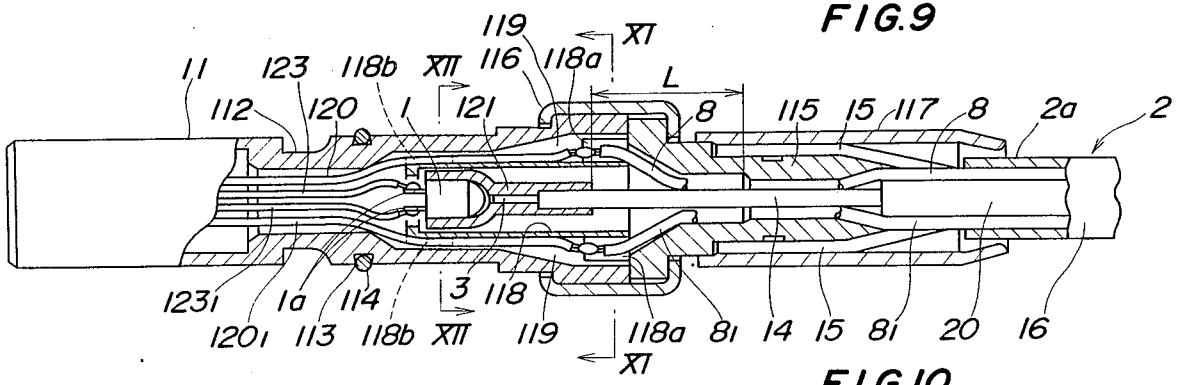
FIG. 9 is a longitudinal sectional view showing an end portion of the locking cable provided with a plug according to the invention.

FIG. 9 illustrates details of the plug and its peripheral parts at an end of the locking cable of the invention. The plug 11 formed of metal has a generally cylindrical body, having its outer peripheral surface formed with an engaging annular groove 112 and an O-ring-fitting groove 113 which are axially juxtaposed with a predetermined axial space therebetween. An O-ring 114 is fitted in the groove 113. A base end face of the plug 11 abuts against an end face of a wire end member 115 formed of metal and being generally cylindrical. A connecting sleeve 116 is fitted over the outer peripheral surfaces of the adjoining portions of the plug 11 and wire end member 115, whereby the plug 11 is combined with the wire end member 115 in one body. The wire end member 115 has a hollow interior communicating with the interior of the plug 11. The optical fiber 3 and the lead wires 8, $8_1$, which are covered with the protective member 14, extend through the hollow interior of the wire end member 115, with respective end portions extending into the interior of the plug 11. The reinforcing cords 15 of the locking cable 2 are inserted between the inner peripheral surface of a cylindrical metal holder 117 fitted over the wire end member 115 and the outer peripheral surface of the wire end member 115. The cylindrical metal holder 117 is caulked to secure the wire end member 115 to one end portion 2*a* of the locking cable. A guide sleeve 118 is fitted in the interior of the plug 11 and extends from an axially central portion to the base end thereof. The guide sleeve 118 has open opposite end faces, and defines a pair of diametrically symmetric spaces 119 between its outer peripheral surface and the inner peripheral surface of the plug 11. The outer peripheral surfaces of front and rear end portions of the guide sleeve 118 are each formed with a pair of lead wire-fitting grooves 118*a* and 118*b* arranged diametrically symmetrically within the space 119. The lead wires 8, $8_1$ of the locking cable 2 are axially movably fitted through the respective lead wire-fitting grooves 118*a* of the rear end portion of the guide sleeve 118. These lead wires 8, $8_1$ are electrically connected with terminal lead wires 120, $120_1$ extending through the lead wire-fitting groove 118*b* of the front end portion of the guide sleeve 118, which in turn are electrically connected with connecting terminals (not shown) provided within the plug 11 at the front end. A holder 121 is axially fitted within the guide sleeve 118, and carries at an end thereof the light emission element 1 fitted therein and at the other end the optical fiber 3 fitted therein. The optical fiber 3 and the light emission element 1 are disposed in face-to-face relation to each other at a predetermined distance apart. The light emission element 1 has connecting terminals 1*a*, 1*a* electrically connected with terminal lead wires 123, $123_1$ extending toward the holder 121 and electrically connected with connecting terminals (not shown) provided in the front end of the plug 11.

The lead wires 8, 8I of the locking cable 2 and the terminal lead wires 120, $120_1$, 123, $123_1$ are loosened enough to have some play in the plug 11 so that they can be axially moved together with the holder 121 when axial tension is given to the optical fiber 3, the lead wires 8, $8_1$, and the terminal lead wires 120, $120_1$, 123, $123_1$ at the time of winding the locking cable 2 into a coil. The holder 121 is movable between the plug 11 and the wire end member 115 through a maximum range L shown in FIG. 9. Since the holder 121 is thus axially movable in the guide sleeve 118 while the end portions of the lead wires 8, $8_1'$ 120, $120_1$, 123, $123_1$ are also axially movable, the possibility of cutting of the lead wires and optical fiber is extremely small at the time of winding the locking cable into a coil.

Figure 10:
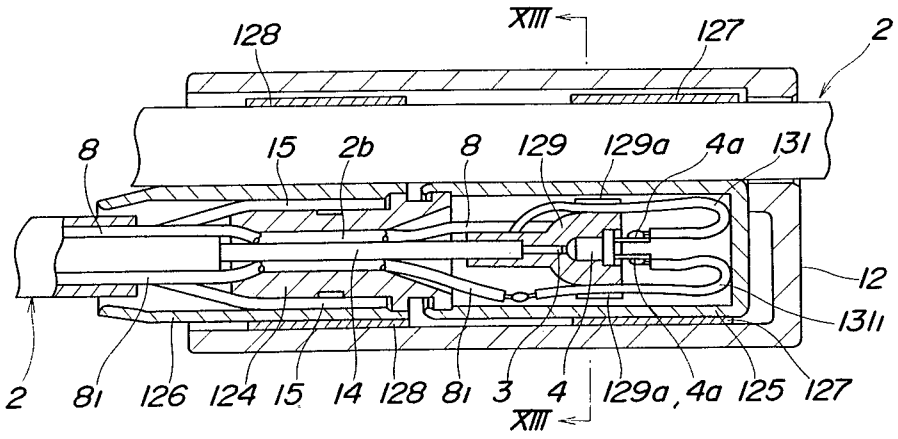
FIG. 10 is a longitudinal sectional view showing another end portion of the flexible tying member in the form of a loop.
Figure 11:
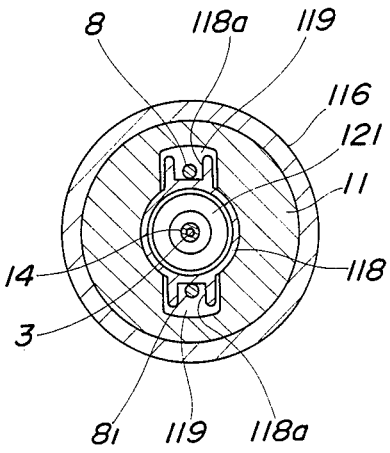
FIG. 11 is a transvere cross-sectional view taken along line XI—XI in FIG. 9.
Figure 12:
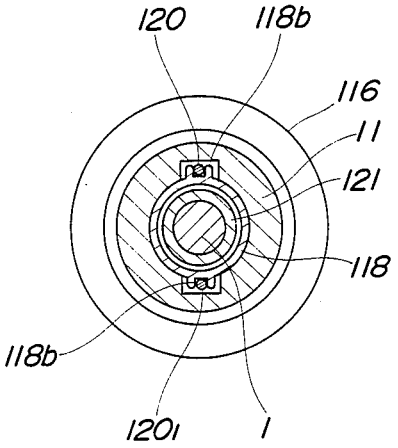
FIG. 12 is a transverse cross-sectional view taken along line XII—XII in FIG. 9.

At the other end portion 2*b* of the locking cable 2, a cylindrical cap member 125 formed of metal with a closed end is fitted on the end portion 2*b* by means of a generally cylindrical wire end member 124 formed of metal interposed between the members 2 and 125, illustrated in FIG. 10. The reinforcing cords 15 of the locking cable 2 are inserted between the inner peripheral surface of a cylindrical metal holder 126 fitted around the outer peripheral surface of the wire end member 124 and the outer peripheral surface of the wire end member 124. The cylindrical metal holder 126 is caulked to secure the wire end member 124 to the other end portion 2*b* of the locking cable 2.

The cap member 125 and the cylindrical metal holder 126 with the same diameter as the cap member 125 abut against each other with their outer peripheral side surfaces parallel to the outer peripheral side surface of a predetermined portion of the locking cable 2, and are firmly held in place by tightening bands 127 and 128, and also by caulking a metal holder 12 accommodating the members 125, 126, 2, etc. The optical fiber 3 and the lead wires 8, $8_1$, which are covered with the protective member 14, extend through the wire end member 124, with their respective end portions extending into the interior of the cap member 125.

Figure 13:
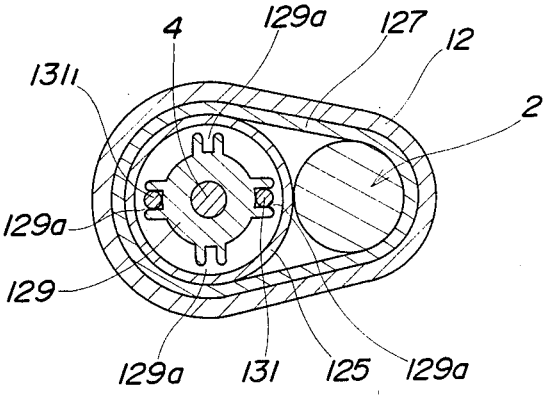
FIG. 13 is a transverse cross-sectional view taken along line XIII—XIII in FIG. 10.

A holder 129 is provided in the cap member 125, which has an enlarged end portion formed with a plurality of (e.g. four) axial grooves 129*a* through which lead wires extend, circumferentially arranged on the outer peripheral surface at equal intervals, as illustrated in FIG. 13. The light receiving element 4 is fitted in the enlarged end portion of the holder 129. Terminal lead wires 131, $131_1$ are electrically connected at one end with respective connecting terminals 4*a*, 4*a*, pass through a pair of axial grooves 129*a*, 129*a* of the holder 129 situated diametrically opposite to each other, and extend toward the wire end member 124, with the other ends electrically connected to the lead wires 8, $8_1$ of the locking cable 2.

Figure 14:
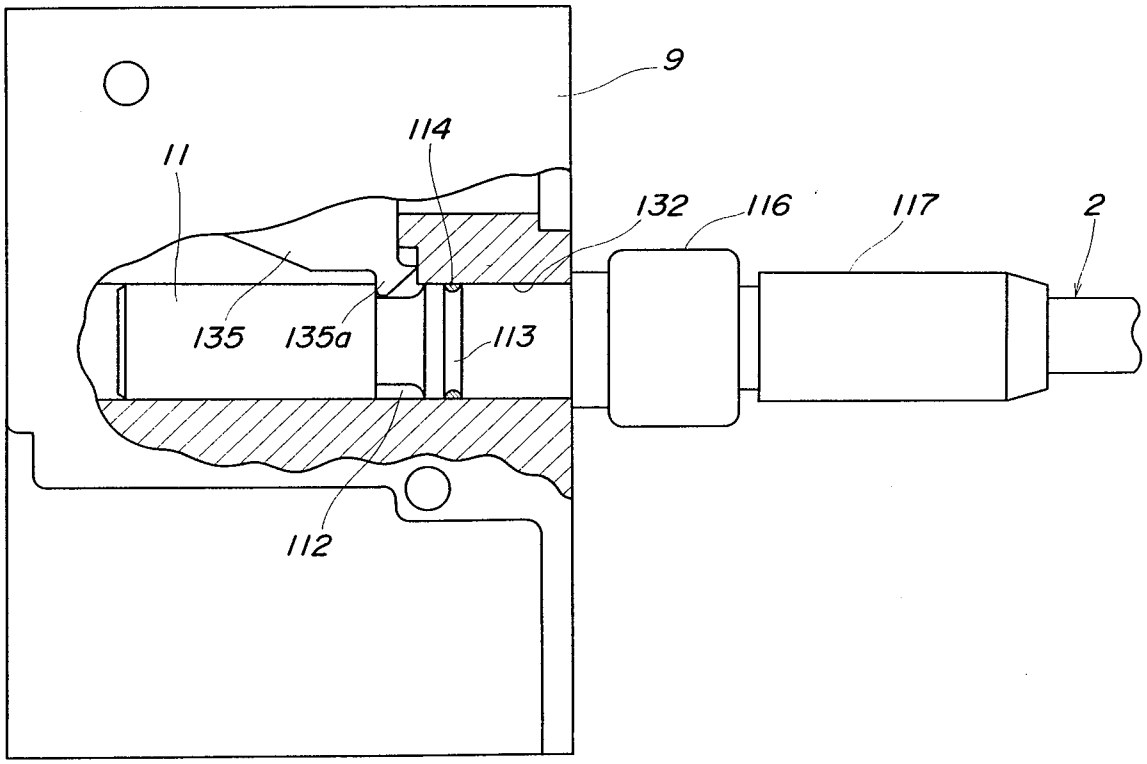
FIG. 14 is a view, partly broken away, the plug side end portion of the locking cable and a casing of the antitheft device, useful in explaining the manner of engagement of them.

On the other hand, the plug 11 is fitted within a fitting hole 132 of the main casing 9 of the antitheft device as illustrated in FIG. 14. The plug 11 is inserted into the fitting hole 132 until an engaging protuberance 135*a* of a lock slider 135 in the main casing 9 becomes engaged with the engaging annular groove 112 of the plug 11. Once the plug 11 has thus been engaged in the fitting hole 132, it cannot be disengaged therefrom unless the lock slider 135 is disengaged from the engaging groove 112 by using an exclusive key (not shown).

Although in the embodiment described above, the plug 11 with the light emission element 1 is provided only at one end of the locking cable. A plug with a light receiving element, similar in construction to the plug 11 of FIG. 9, may be provided at the other end of the locking cable, in place of the arrangement of FIG. 10, wherein the plugs of the locking cable may be locked or unlocked by a key with respect to the main casing 9 of the antitheft device.

What is claimed is:

1. An antitheft device including a locking cable, an optical fiber longitudinally extending through said locking cable, a pair of photoelectric elements arranged at opposite ends of said optical fiber, and warning means responsive to a change in an electrical signal generated by one of said photoelectric elements and corresponding to a change in a photo signal generated by the other of said photoelectric elements and transmitted through said optical fiber, said locking cable comprising:

a longitudinally extending core portion including said optical fiber disposed along an axis thereof;

a longitudinally extending first reinforcing layer concentrically disposed around said core portion and including a plurality of first reinforcing members;

a longitudinally extending second reinforcing layer concentrically disposed around said first reinforcing layer and including two electric conductors and a plurality of second reinforcing members, each of said electric conductors comprising a single wire, each of said second reinforcing members comprising a plurality of strands each formed of a plurality of twisted steel wires, said electric conductors being arranged diametrically symmetrical to each other with respect to said core portion, said electric conductors and said second reinforcing members being of substantially the same diameter and at substantially the same radial distance from an axis of said locking cable, and said electric signal being transmitted exclusively through said electric conductors; and an outermost layer formed solely by a flexible hollow protective member disposed around said longitudinally extending second reinforcing layer, said flexible hollow protective member having an inner peripheral surface and covering said electric conductors and said second reinforcing members in a manner such that said electric conductors and said second reinforcing members are disposed in contact with said inner peripheral surface of said flexible hollow protective member, said first reinforcing members being wound around said core portion in a manner extending parallel with each other, and said electric conductors and said second reinforcing members being wound around said first concentric portion in a manner longitudinally extending parallel with each other.

2. An antitheft device as claimed in claim 1, wherein said core portion includes a flexible hollow protective member covering said optical fiber.

3. An antitheft device as claimed in claim 1, wherein said first reinforcing layer includes a flexible hollow protective member covering said first reinforcing members.

4. An antitheft device as claimed in claim 1, wherein said first reinforcing members are formed of a fiber material.

5. An antitheft device as claimed in claim 1, wherein said antitheft device includes a fixture fixed to an object which is to be protected from theft, and connecting means for mechanically and electrically connecting said locking cable to said fixture, said connecting means comprising a plug provided at an end of said locking cable, a guide sleeve arranged within said plug, and a holder axially movably disposed within said guide sleeve, said holder holding an end of said optical fiber in face-to-face relation to an end of one of said photoelectric elements, at least one space being defined between an inner peripheral surface of said plug and an outer peripheral surface of said guide sleeve, said at least one electric conductor axially movably extending through said at least one space.

6. An antitheft device as claimed in claim 5, wherein said guide sleeve has said outer peripheral surface thereof formed with at least one axial groove located in said at least one space and through which said at least one electric conductor extends.

7. An antitheft device as claimed in claim 6, wherein said at least one space comprises a pair of spaces arranged diametrically symmetrical with respect to said guide sleeve, said at least one axial groove comprising a pair of axial grooves located in respective ones of said spaces.

8. An antitheft device as claimed in claim 1, wherein said outermost layer is formed of a flexible hollow tubular member.

* * * * *